US009267394B2

(12) United States Patent
Pieper et al.

(10) Patent No.: US 9,267,394 B2
(45) Date of Patent: Feb. 23, 2016

(54) STEAM TURBINE PLANT WITH VARIABLE STEAM SUPPLY

(75) Inventors: Norbert Pieper, Duisburg (DE); Michael Wechsung, Mülheim an der Ruhr (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 478 days.

(21) Appl. No.: 13/879,858

(22) PCT Filed: Oct. 12, 2011

(86) PCT No.: PCT/EP2011/067811

§ 371 (c)(1), (2), (4) Date: Apr. 17, 2013

(87) PCT Pub. No.: WO2012/055703

PCT Pub. Date: May 3, 2012

(65) Prior Publication Data

US 2013/0205749 A1 Aug. 15, 2013

(30) Foreign Application Priority Data

Oct. 29, 2010 (EP) ..... 10189417

(51) Int. Cl.

*F01K 7/34* (2006.01)
*F01K 7/06* (2006.01)
*F01K 23/10* (2006.01)
(Continued)

(52) U.S. Cl.

CPC . *F01K 23/10* (2013.01); *F01K 7/18* (2013.01); *F01K 7/20* (2013.01); *F01K 23/101* (2013.01); *F01K 23/108* (2013.01); *F22B 1/1815* (2013.01)

(58) Field of Classification Search

CPC ..... F01K 23/10; F01K 7/18; F01K 7/20; F01K 23/108; F01K 23/101; F22B 1/1815
USPC ..... 60/653, 662, 663, 677–679
See application file for complete search history.

(56) References Cited

U.S. PATENT DOCUMENTS 3,342,195 A * 9/1967 Wagner ..... F01K 7/345 361/242
4,156,578 A * 5/1979 Agar ..... F04D 27/001 415/1

(Continued)

FOREIGN PATENT DOCUMENTS

CN 201363168 Y 12/2009
DE 10227709 A1 2/2003

(Continued)

*Primary Examiner* — Hoang Nguyen

(57) ABSTRACT

A steam turbine plant has a steam turbine and an inlet steam collection line with an inlet steam collection line segment is provided. The inlet steam collection line supplies a steam consumer and is introduced into outlet steam flow of the steam turbine at an inlet steam introduction point of the inlet steam collection line segment. A supply steam device has a switching armature for connecting the supply steam device to the inlet steam collection line segment upstream of the inlet steam introduction point. The armature is triggered and switched such that if outlet steam pressure in the inlet steam collection line segment is lower than target pressure, the inlet steam collection line segment is connected to the supply steam device for conducting steam and disconnected between the armature and the inlet steam introduction point, otherwise the supply steam device is separated from the inlet steam collection line segment.

10 Claims, 1 Drawing Sheet

(51) Int. Cl.

| | |
|---|---|
| ***F22B 1/18*** | (2006.01) |
| ***F01K 7/18*** | (2006.01) |
| ***F01K 7/20*** | (2006.01) |

(56) References Cited

U.S. PATENT DOCUMENTS 4,309,873 A * 1/1982 Koran ..... F01D 25/08 60/646
4,362,013 A * 12/1982 Kuribayashi ..... F01K 23/10 60/39.182
4,448,026 A * 5/1984 Binstock ..... F01D 17/105 60/662

FOREIGN PATENT DOCUMENTS

| | | | |
|---|---|---|---|
| EP | 2136037 | A2 | 12/2009 |
| EP | 2206894 | A1 | 7/2010 |
| JP | 60166704 | A | 8/1985 |
| JP | 61226505 | A | 10/1986 |
| WO | WO 9300501 | A1 | 1/1993 |
| WO | WO 2011030285 | A1 | 3/2011 |

* cited by examiner

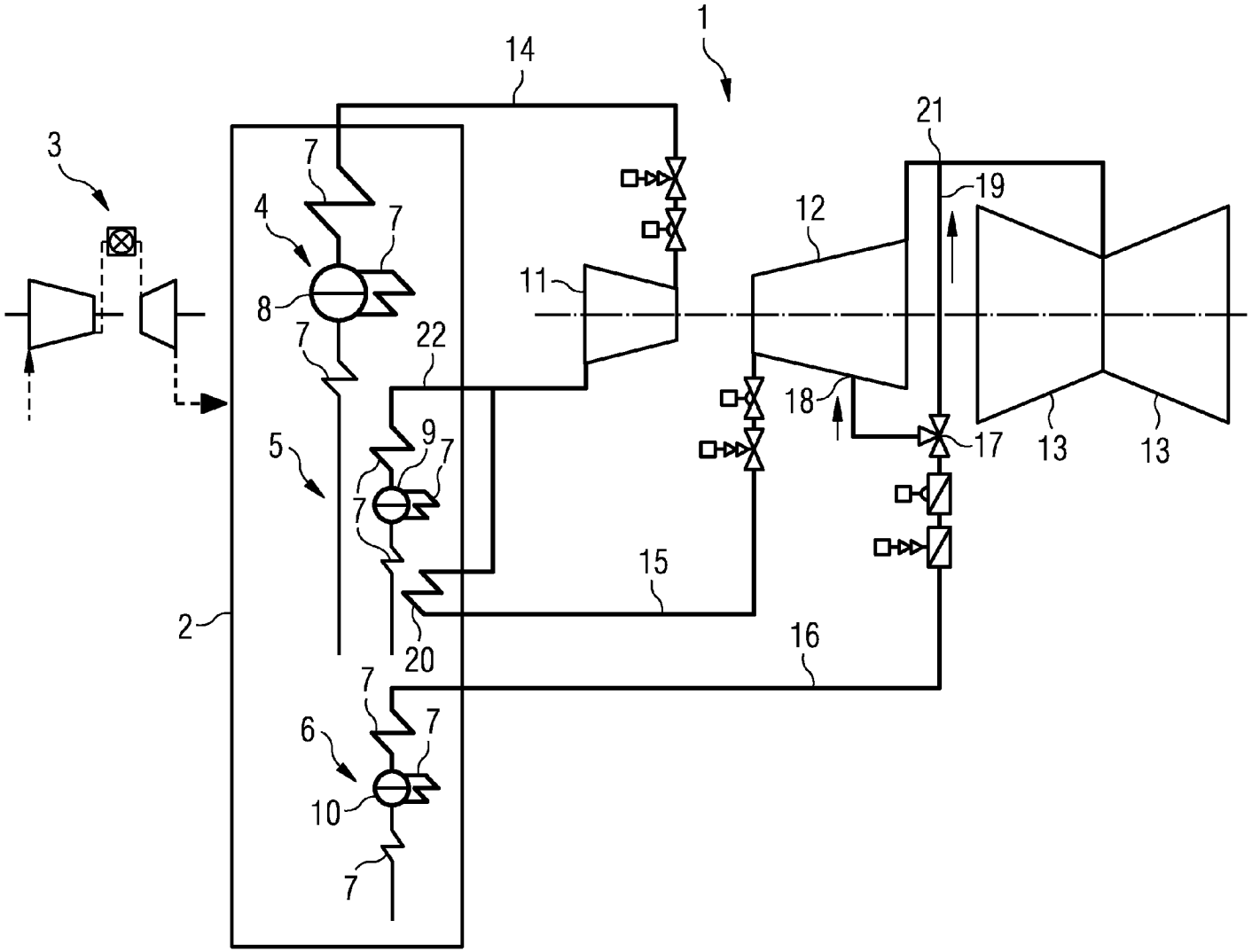
1
2
3
4
5
6
7
8
9
10
11
12
13
13
14
15
16
17
18
19
20
21
22

STEAM TURBINE PLANT WITH VARIABLE STEAM SUPPLY

CROSS REFERENCE TO RELATED APPLICATIONS

This application is the US National Stage of International Application No. PCT/EP2011/067811 filed Oct. 12, 2011 and claims benefit thereof, the entire content of which is hereby incorporated herein by reference. The International Application claims priority to the European application No. 10189417.8 EP filed Oct. 29, 2010, the entire content of which is hereby incorporated herein by reference.

FIELD OF INVENTION

The invention relates to a steam turbine plant with variable steam supply.

BACKGROUND OF THE INVENTION

Steam turbine plants are usually dimensioned from economic points of view. Particularly in the case of steam turbine plants which are used in electric power generation, operation is carried out with very large power units for achieving the highest levels of efficiency. The efficiency, moreover, is to be constant over an operating range which is as wide as possible. To this end, it is known to feed inlet steam, especially a low-pressure inlet steam, into an intermediate-pressure steam turbine or low-pressure steam turbine. If the steam turbine is run in partial load operation, for example, the inlet steam has to be throttled at the feed point, providing this is made available at constant pressure.

In combined gas and steam turbine plants, steam is produced for a plurality of pressure stages, for example live steam, intermediate-pressure inlet steam and low-pressure inlet steam during a triple pressure process. In this case, a fuel with high sulfur content is frequently used. In this case, it may be necessary to increase the pressure of the low-pressure inlet steam in order to prevent sulfurous acid condensing out on the heat transfer surfaces of a steam generator on account of the high sulfur content of the fuel. In return, the low-pressure inlet steam needs to be correspondingly throttled at the feed point. It is disadvantageous in this case that energy is consumed with the throttling of the inlet steam, that is to say the capability of the steam to perform work in the cyclic process reduces, as a result of which the efficiency of the overall steam power process falls.

SUMMARY OF INVENTION

The invention is based on the object of creating a steam turbine plant in which the aforesaid problems are overcome and particularly throttling losses are avoided as far as possible. Furthermore, it is an object of the invention to propose a method for operating the steam turbine plant in which particularly throttling losses are avoided as far as possible.

The object is achieved according to a steam turbine plant and a method as claimed in the independent claims. Advantageous developments are described in the dependent claims.

In a steam turbine plant with a steam turbine and an inlet-steam collection line, having an inlet-steam collection line section, for supplying a steam consumer, the inlet-steam collection line, at an inlet-steam introduction point of the inlet-steam collection line section, is introduced into the exhaust steam flow of the steam turbine and a feed steam device is provided with a changeover valve on the steam turbine with which the feed steam device is connected upstream of the inlet-steam introduction point to the inlet-steam collection line section and, if the exhaust steam pressure is lower than a setpoint pressure in the inlet-steam collection line section, can be selectively switched over in such a way that the inlet-steam collection line section is connected in a steam conducting manner to the feed steam device and is interrupted between the changeover valve and the inlet-steam introduction point, otherwise the feed steam device is disconnected from the inlet-steam collection line section.

According to the invention, when the setpoint pressure in the inlet-steam collection line section is fallen short of the changeover valve is switched over in such a way that feed steam is admitted into the steam turbine via the feed steam device. If the exhaust steam pressure of the steam turbine corresponds to the setpoint pressure, or lies above it, the feed steam device is disconnected from the inlet-steam collection line section and the steam turbine does not receive feed steam via the feed steam device. If the steam turbine plant is operated in partial load, as a result of which the pressure in the interior of the steam turbine correspondingly falls, or if a highly sulfurous fuel is used when operating a gas turbine plant which is coupled to the steam turbine plant, wherein the low-pressure steam pressure is usually increased in order to prevent sulfurous acids condensing out and therefore corrosion of the components of the heat recovery boiler, the inlet steam, by means of the changeover valve, can be introduced upstream via the feed steam device and expanded in the steam turbine.

The feed steam device preferably has a multiplicity of steam feed points on different stages of the steam turbine and the feed steam device can be activated in such a way that the supply of feed steam is carried out only at that steam feed point at which the pressure at the introduction position inside the steam turbine is certainly higher than that of the feed steam itself but at which the pressure difference is minimal. The feed steam is consequently fed into the steam turbine in such a way that a possibly necessary throttling of the feed steam is superfluous, as a result of which the steam turbine plant according to the invention is free of unnecessary throttling losses.

With a load reduction of the steam turbine, the feed steam device is preferably activated in such a way that starting from the steam feed point which is formed on a stage of the steam turbine which is disposed on the exhaust steam side, the feed steam device activates that steam feed point which is formed on an adjacent, upstream-disposed stage of the steam turbine. With a load increase of the steam turbine, the feed steam device is preferably activated in such a way that starting from a steam feed point which is formed on an upstream-disposed stage of the steam turbine, the feed steam device activates that steam feed point which is formed on an adjacent stage of the steam turbine which is disposed on the exhaust steam side.

An intermediate-pressure steam turbine or low-pressure steam turbine is preferably provided as a steam consumer of the steam turbine plant.

Furthermore, the characteristic curve of the opening degree of the changeover valve for the connecting and disconnecting of the feed steam device and/or the characteristic curve of the opening degree of the changeover valve for the connecting and disconnecting of the inlet-steam collection line section are preferably linear, progressive or degressive.

A method for operating the steam turbine plant preferably has the steps: making available of the steam turbine plant; establishing of a setpoint pressure for the inlet-steam collection line; switching over of the changeover valve so that if the exhaust steam pressure is lower than the setpoint pressure in the inlet-steam collection line section, the inlet-steam collection line section is connected in a steam-conducting manner to the feed steam device and is interrupted between the changeover valve and the inlet-steam introduction point; or switching over of the changeover valve so that if the exhaust steam pressure is equal to, or higher than, the setpoint pressure in the inlet-steam collection line section, the feed steam device is disconnected from the changeover valve and inlet steam is delivered directly from the inlet-steam collection line section to the inlet-steam introduction point.

In the method, the feed steam device also preferably has a multiplicity of steam feed points on different stages of the steam turbine and the feed steam device is activated in such a way that the supply of feed steam is carried out only at that feed steam point at which the pressure difference between the feed position inside the steam turbine and the feed steam is minimal. In this case, with a load reduction of the steam turbine the feed steam device is preferably activated in such a way that starting from the steam feed point which is formed on a stage of the steam turbine which is disposed on the exhaust steam side, the feed steam device activates that steam feed point which is formed on an adjacent, upstream-disposed stage of the steam turbine. With a load increase of the steam turbine, the feed steam device is preferably activated in such a way that starting from a steam feed point which is formed on a upstream-disposed stage of the steam turbine, the feed steam device activates that steam feed point which is formed on an adjacent stage of the steam turbine which is disposed on the exhaust steam side.

BRIEF DESCRIPTION OF DRAWINGS

In the following text, a preferred embodiment of a gas and steam turbine plant according to the invention is explained with reference to the attached schematic drawing. The FIGURE shows a gas and steam turbine plant with variable steam supply.

DETAILED DESCRIPTION OF INVENTION

Shown in the FIGURE is a steam turbine plant 1 which, via a heat recovery boiler 2, is coupled to a gas turbine plant 3. The heat recovery boiler 2 comprises a high-pressure steam system 4 with a live steam collection line 14, an intermediate-pressure steam system 5 with an intermediate-pressure inlet-steam collection line 15, a low-pressure steam system 6 with a low-pressure inlet-steam collection line 16, and a plurality of heat exchangers 7.

In the heat recovery boiler 2, the thermal energy of the hot exhaust gases of the gas turbine plant 3, by means of the heat exchangers 7, is released to a respectively associated boiler installation 8, 9, and 10 for producing steam. The steam which is produced in the boiler installations 8, 9 and 10 serves for operating a high-pressure steam turbine 11, an intermediate-pressure steam turbine 12 and a low-pressure steam turbine 13.

The high-pressure steam turbine 11 and the intermediate-pressure steam turbine 12 are coupled by means of one of the steam collection lines 14 and 15 in each case to the respectively corresponding steam system 4 or 5. The intermediate-pressure inlet-steam collection line 15 also has a reheater 20 by means of which intermediate-pressure steam is superheated in the heat recovery boiler 2 for increasing the efficiency of the steam turbine plant 1. The intermediate-pressure steam consists of the intermediate-pressure inlet steam which is produced in the boiler installation 9 and the exhaust steam of the high-pressure steam turbine 11. From the reheater 20, the superheated intermediate-pressure steam flows via the intermediate-pressure steam collection line 22 to the intermediate-pressure steam turbine 12.

Via a low-pressure inlet-steam collection line 16, the low-pressure inlet steam flows from the boiler installation 10 to a changeover valve 17. The pressure of the inlet steam in the low-pressure inlet-steam collection line 16 is 4.2 bar in the present case. In the case of using a fuel with high sulfur content when operating the gas turbine plant 3, the pressure of the low-pres sure inlet steam is increased in such a way as to prevent sulfurous acid from condensing out on the heat transfer surfaces of the heat exchangers 7 and consequently to prevent the heat transfer surfaces from corroding. As a result, a pressure of 8 bar, for example, is produced in the low-pressure inlet-steam collection line 16.

The low-pressure inlet-steam collection line 16 also has a low-pressure inlet-steam collection line 19 on which an inlet-steam introduction point 21 is formed. Via the inlet-steam introduction point 21, the low-pressure inlet steam is fed via the low-pressure inlet-steam collection line section 19 with the exhaust steam of the intermediate-pressure steam turbine 12.

A control device (not shown) is associated with the changeover valve 17 and, in the event of the exhaust steam pressure of the intermediate-pressure steam turbine 12 falling short of a predetermined setpoint value, for example 4 bar, especially created as a result of a partial-load operation of the intermediate-pressure steam turbine 12, is designed to switch over the changeover valve 17 in such a way that the inlet steam flows via the changeover valve 17 to a feed steam device 18. If, for example, the operating state of the intermediate-pressure steam turbine 12 drops from a full-load operation to a partial-load operation of 60% of the full load, the exhaust steam pressure also drops accordingly, i.e. the exhaust steam pressure drops to 60% of the exhaust steam pressure at full load. As a result, the setpoint value is fallen short of and the changeover valve 17 is switched over, as a result of which the inlet steam flows to the feed steam device 18, via which it flows as feed steam into the intermediate-pressure turbine 12. Therefore, the inlet steam is expanded from the pressure level in the low-pressure inlet-steam collection line 16 to the pressure level at the inlet-steam introduction point 21 in the intermediate-pressure turbine 12 and is therefore energetically utilized.

The feed steam device 18 has a multiplicity of steam feed points (not shown), of which only one at most is activated. That is to say, the feed of steam is always carried out at one steam feed point only. In this case, that steam feed point at which the pressure of the steam turbine process steam is approximately equal to the pressure of the feed steam is activated. This enables an almost unthrottled supply of feed steam, as a result of which an additional throttling loss as a result of throttling is avoided. On account of flow losses, the inlet steam, after passing the changeover valve 17, has a slightly lower pressure at the steam feed point than in the low-pressure inlet-steam collection line 16, for example 4 bar.

If the exhaust steam pressure which is measured by the control device is higher than, or equal to, the setpoint value, the changeover valve 17 is switched over in such a way that the inlet steam flow flows via the low-pressure inlet-steam collection line section 19 to the low-pressure steam turbine 13. In the low-pressure inlet-steam collection line section 19, the exhaust steam of the intermediate-pressure turbine 12, which has previously been expanded to 4 bar, and the steam of the low-pressure inlet-steam collection line 16, which in the present case also has a pressure of 4 bar, then converge at the inlet-steam introduction point 21 and flow to the low-pressure turbine 13.

The invention claimed is:

1. A steam turbine plant for supplying a steam consumer, comprising:

a steam turbine comprising a feed steam device; and an inlet-steam collection line comprising an inlet-steam collection line section, wherein the inlet-steam collection line at an inlet-steam introduction point of the inlet-steam collection line section is introduced into an exhaust steam flow of the steam turbine, wherein the feed steam device comprises a changeover valve, wherein the feed steam device is connected upstream of the inlet-steam introduction point to the inlet-steam collection line section by the changeover valve, and wherein the feed steam device is selectively switched over by the changeover valve so that if an exhaust steam pressure is lower than a setpoint pressure in the inlet-steam collection line section, the inlet-steam collection line section is connected to the feed steam device for conducting a steam to the feed steam device and is disconnected between the changeover valve and the inlet-steam introduction point, and if the exhaust steam pressure is equal to or higher than the setpoint pressure, the inlet-steam collection line section is disconnected from the feed steam device.

2. The steam turbine plant as claimed in claim 1, wherein the feed steam device comprises a plurality of steam feed points on different stages of the steam turbine and is activated so that the steam is fed at a steam feed point at which a pressure difference between an introduction position inside the steam turbine and the steam is minimal.

3. The steam turbine plant as claimed in claim 1, wherein the feed steam device comprises a plurality of steam feed points on different stages of the steam turbine, and wherein with a load reduction of the steam turbine, starting from a steam feed point formed on a stage disposed on an exhaust steam side, the feed steam device activates another steam feed point formed on an adjacent upstream-disposed stage.

4. The steam turbine plant as claimed in claim 1, wherein the feed steam device comprises a plurality of steam feed points on different stages of the steam turbine, and wherein with a load increase of the steam turbine, starting from a steam feed point formed on an upstream-disposed stage, the feed steam device activates another steam feed point formed on an adjacent stage disposed on an exhaust steam side.

5. The steam turbine plant as claimed in claim 1, wherein the steam consumer is an intermediate-pressure steam turbine or a low-pressure steam turbine.

6. The steam turbine plant as claimed in claim 1, wherein a characteristic curve of an opening degree of the changeover valve for connecting and disconnecting to the feed steam device and/or for connecting and disconnecting to the inlet-steam collection line section is linear, progressive or degressive.

7. A method for operating a steam turbine plant, comprising:

providing the steam turbine plant as claimed in claim 1;

establishing a setpoint pressure in the inlet-steam collection line;

switching over the changeover valve so that if an exhaust steam pressure is lower than the setpoint pressure, the inlet-steam collection line section is connected to the feed steam device for conducting a steam to the feed steam device and is disconnected between the changeover valve and the inlet-steam introduction point; and switching over the changeover valve so that if the exhaust steam pressure is equal to or higher than the setpoint pressure, the feed steam device is disconnected from the changeover valve and inlet steam is delivered from the inlet-steam collection line section to the inlet-steam introduction point.

8. The method as claimed in claim 7, wherein the feed steam device comprises a plurality of steam feed points on different stages of the steam turbine and is activated so that the steam is fed at a steam feed point at which a pressure difference between an introduction position inside the steam turbine and the steam is minimal.

9. The method as claimed in claim 7, wherein the feed steam device comprises a plurality of steam feed points on different stages of the steam turbine, and wherein with a load reduction of the steam turbine, starting from a steam feed point formed on a stage disposed on an exhaust steam side, the feed steam device activates another steam feed point formed on an adjacent upstream-disposed stage.

10. The method as claimed in claim 7, wherein the feed steam device comprises a plurality of steam feed points on different stages of the steam turbine, and wherein with a load increase of the steam turbine, starting from a steam feed point formed on an upstream-disposed stage, the feed steam device activates another steam feed point formed on an adjacent stage disposed on an exhaust steam side.

* * * * *